US005334228A

United States Patent [19]

Ashjian et al.

[11] Patent Number: 5,334,228

[45] Date of Patent: Aug. 2, 1994

[54] DEPOSIT CONTROL ADDITIVES AND FUEL COMPOSITIONS CONTAINING THE SAME

[75] Inventors: Henry Ashjian, E. Brunswick; Matthew P. Miller, Toms River, both of N.J.; Dong-Ming Shen, Langhorne, Pa.; Margaret M. Wu, Skillman, N.J.

[73] Assignee: Mobil Oil Corporation, Fairfax, Va.

[21] Appl. No.: 137,539

[22] Filed: Oct. 18, 1993

[51] Int. Cl.[5] ..... C10L 1/16; C10L 1/22

[52] U.S. Cl. ..... 44/347; 44/415; 44/418; 44/432; 44/433

[58] Field of Search ..... 252/51.5 A, 9; 44/347, 44/415, 418, 432, 433, 623; 585/14

[56] References Cited

U.S. PATENT DOCUMENTS

| | | | |
|---|---|---|---|
| 3,849,473 | 11/1974 | Inamoto et al. | 260/468 |
| 4,952,747 | 8/1990 | Alexander et al. | 585/803 |
| 4,952,748 | 8/1990 | Alexander et al. | 585/803 |
| 4,952,749 | 8/1990 | Alexander et al. | 585/803 |
| 4,982,049 | 1/1991 | Alexander et al. | 585/803 |
| 5,016,712 | 5/1991 | Cullick et al. | 166/250 |
| 5,043,503 | 8/1991 | Del Rossi et al. | 585/360 |
| 5,089,028 | 2/1992 | Abramo et al. | 44/347 |
| 5,120,899 | 6/1992 | Chen et al. | 585/803 |

*Primary Examiner*—Prince Willis, Jr.
*Assistant Examiner*—Cephia D. Toomer
*Attorney, Agent, or Firm*—Alexander J. McKillop; Dennis P. Santini; Laurence P. Hobbes

[57] ABSTRACT

A fuel additive having detergency, solubility and thermal stability comprises a detergent component, e.g., polyalkenyl succinimide, and a carrier fluid obtained from a diamondoid fluid comprising an compound selected from the group consisting of adamantane, diamantane, triamantane, tetramantane, and the alkyl-substituted derivatives thereof.

20 Claims, No Drawings

DEPOSIT CONTROL ADDITIVES AND FUEL COMPOSITIONS CONTAINING THE SAME

FIELD OF THE INVENTION

The invention relates to additives for motor fuels. Specifically, the invention relates to deposit control fuel additives for gasolines.

BACKGROUND OF THE INVENTION

During operation of an internal combustion engine, fuel and lubricant deposits accumulate and bake onto the intake valves and intake ports of the fuel system. These deposits restrict the flow of air and fuel entering the combustion chamber which can cause stalling and hesitation, especially during "cold-start" operation.

Conventional detergents such as polyalkenyl succinimides as gasoline detergent additives are described as effective in providing carburetor cleanliness and port fuel injector cleanliness. However, the polyalkenyl succinimides alone offer little intake valve cleanliness performance. U.S. Pat. No. 5,089,028, incorporated herein by reference, discloses polyalkenyl succinimide-containing detergent fuel additives providing such performance which utilize carrier fluids having low temperature fluidity and solvency. Such fluids can include polymers or copolymers of olefinic hydrocarbons, aliphatic or aromatic carboxylic acid esters, polyethers, and synthetic or mineral oils such as solvent refined naphthenic mineral oils. However, such carrier fluids can be expensive and difficult to prepare. In any event, the substitution of lower cost substituents for such fluids would be advantageous.

Many hydrocarbonaceous mineral streams contain some small proportion of diamondoid compounds. These high boiling, saturated, three-dimensional polycyclic organics are illustrated by adamantane, diamantane, triamantane and various side chain substituted homologues, particularly the methyl derivatives. These compounds have high melting points and high vapor pressures for their molecular weights and have recently been found to cause problems during production and refining of hydrocarbonaceous minerals, particularly natural gas, by condensing out and solidifying, thereby clogging pipes and other pieces of equipment. For a survey of the chemistry of diamondoid compounds, see Fort, Jr., Raymond C., *The Chemistry of Diamond Molecules,* Marcel Dekker, 1976.

In recent times, new sources of hydrocarbon minerals have been brought into production which, for some unknown reason, have substantially larger concentrations of diamondoid compounds. Whereas in the past, the amount of diamondoid compounds has been too small to cause operational problems such as production cooler plugging, now these compounds represent both a larger problem and a larger opportunity. The presence of diamondoid compounds in natural gas has been found to cause plugging in the process equipment requiring costly maintenance downtime to remove. On the other hand, these very compounds which can deleteriously affect the profitability of natural gas production are themselves valuable products.

The problem of deposition and plugging by solid diamondoids in natural gas production equipment has been successfully addressed by a controlled solvent injection process. Alexander and Knight U.S. Pat. No. 4,952,748 teaches the process for extracting diamondoid compounds from a hydrocarbon gas stream by contacting the diamondoid-laden hydrocarbon gas with a suitable solvent to preferentially dissolve the diamondoid compounds into the solvent. Cullick and Roach U.S. Pat. No. 5,016,712 teaches a method for locating the solvent injection point within the natural gas wellbore.

Further studies have revealed that separation of the diamondoid compounds from the diamondoid-enriched solvent is complicated by the fact that numerous diamondoid compounds boil in a narrow range of temperatures surrounding the boiling range of the most preferred solvents. Alexander et al. U.S. Pat. Nos. 4,952,747, 4,952,749, and 4,982,049 teach various methods of concentrating diamondoid compounds in the solvent for, among other reasons, recycling the lean solvent fraction for reuse. Each of these processes produces an enriched solvent stream containing a mixture of diamondoid compounds. Chen and Wentzek U.S. Pat. No. 5,120,899 teaches a method for recovering diamondoids from a natural gas stream with a synthetic solvent which can be easily purified and recycled for continuous operation. The diamondoids recovered by the method of the '899 patent contain essentially no solvent contaminants.

Additional natural gas sources have now been discovered which produce a normally liquid mixture of diamondoid compounds, and, in accordance with the present invention, it has been found that these normally liquid diamondoid mixtures can be readily employed with detergent additives, e.g., polyalkenyl succinimides, e.g., as carrier fluids.

SUMMARY OF THE INVENTION

The present invention provides a gasoline additive which can be used in a minor effective amount as a carburetor, port fuel injector and intake valve cleanliness additive which limits the amount of deposit formation. The components of the additive clean the fuel system of a spark ignition internal combustion engine, when added to a fuel in an amount of at least 10 to 100, at most 200 to 500 pounds of additive per 1,000 barrels of fuel (lbs/MB). All the fuel system components, particularly the carburetor, fuel lines, fuel injectors, port fuel injectors and intake valves can be cleaned by exposure to small amounts of the additive combination in solution with the fuel. The additive formulation of the present invention, when used in minor concentrations, limits the amount of deposit formation.

The additive of the invention can be employed in both high quality premium unleaded as well as regular unleaded gasolines thus providing effective detergency properties for all kinds of vehicles.

The invention is directed to an additive for normally liquid fuels having detergency, solubility and stability comprising a combination of i) a detergent component, and ii) a carrier fluid comprising at least one component selected from the group consisting of adamantane, diamantane, triamantane, tetramantane, and the alkyl-substituted derivatives thereof.

In yet another aspect, the invention can be described as a liquid fuel composition comprising a major amount of a liquid fuel and an additive having detergency, solubility and thermal stability, the additive comprising a combination of i) a detergent component, e.g., polyalkenyl succinimide; and ii) at least one component selected from the group consisting of adamantane, diamantane, triamantane, tetramantane, and the alkyl-substituted derivatives thereof.

In each of the above aspects of the present invention, the element ii) can be derived from diamondoid fluids.

DETAILED DESCRIPTION OF THE INVENTION

Diamondoid Carrier Fluid Component

Additional natural gas sources have now been discovered which produce a normally liquid mixture of diamondoid compounds, and, in accordance with the present invention, it has been found that these normally liquid diamondoid mixtures or a fraction thereof can be used as a carrier fluid for motor fuel additives such as detergent, anti-oxidants, or anti-wear compounds, especially in gasoline.

Generally, the diamondoid fluid comprises at least one component selected from the group consisting of adamantane, diamantane, triamantane, tetramantane, and the alkyl-substituted derivatives thereof. In one embodiment, the additive comprises at least two or three elements selected from the group consisting of adamantane, diamantane, triamantane, tetramantane, and the alkyl-substituted derivatives thereof.

The diamondoid component can be a composition which has been processed to remove light ends, i.e., at least a portion of organics having fewer than 10 carbon atoms. In one embodiment, said composition comprises at least about 65 weight percent alkyl-substituted diamondoid compounds which have more than one quaternary carbon atom per molecule and less than about 35 weight percent of diamondoid compounds which have less than two quaternary carbon atoms per molecule. Examples of diamondoid compounds which contain more than one quaternary carbon include 1,3-dimethyladamantane; 1,3,5-trimethyladamantane; 1,3,5,7-tetramethyladamantane; cis- and trans-1,4-dimethyladamantane; cis- and trans-1,3,4-trimethyladamantane; 1,2,5,7-tetramethyladamantane; 4,9-dimethyldiamantane; 1,4-dimethyldiamantane; 2,4-dimethyldiamantane; 4,8-dimethyldiamantane; and 3,4-dimethyldiamantane.

The diamondoid component ii) of the additive of the invention preferably contains more than 65 weight percent of diamondoid compounds having more than one quaternary carbon atom per molecule and less than 20 weight percent of diamondoids having fewer than two quaternary carbon atoms per molecule.

The diamondoid component of the additive composition of the invention can be obtained by distilling to remove lower-boiling components without significantly increasing its freeze point but markedly increasing its specific gravity.

The diamondoid fluid (element ii)) has a viscosity ranging from 1.5 to 40 cS at 100° C, preferably 2 to 20 cS at 100° C., at a viscosity index (VI) ranging from 60 to 150, preferably 80 to 140, and a pour point less than −20° C., preferably less than −30° C. In one embodiment, the diamondoid fluid comprises up to 90 wt %, preferably 10 to 60 wt % adamantanes, up to 90 wt %, preferably 20 to 80 wt % diamantanes, up to 60 wt %, preferably up to 50 wt % triamantanes, and up to 25 wt %, preferably up to 15 wt % tetramantanes.

Detergent Component

The additive of the present invention also contains a range of from about 10 to 80 wt %, preferably about 20 to 50 wt %, based on the total weight of the additive, of a conventional detergent component. Suitable detergent components are selected from the group consisting of polyamines, polyether amines, polyalkenyl succinimides, polyalkenyl succinic esters, Mannich bases and polyalkylsuccinic amides, amines, imides and imines.

Polyamines suitable for use in the present invention are disclosed in U.S. Pat. Nos. 3,272,746; 3,438,757; 3,752,657; 4,022,589; 4,409,000; and 4,608,185, the relevant portions of which are incorporated herein by reference.

Polyether amines suitable for use in the present invention are disclosed in U.S. Pat. Nos. 4,191,537; 4,234,321; 4,274,837; 4,288,612; 4,604,103; 4,695,291; 4,737,160; and 4,747,851, the relevant portions of which are incorporated herein by reference.

Polyalkenyl succinimides suitable for use in the present invention are disclosed in U.S. Pat. Nos. 3,219,666; 4,098,585; and 5,089,028, the relevant portions of which are incorporated herein by reference.

Polyalkenyl succinic esters suitable for use in the present invention are disclosed in U.S. Pat. Nos. 3,381,022; 3,522,179; 3,531,440; 3,708,522; 3,804,763; 3,901,665; 4,123,373; and 4,491,527, the relevant portions of which are incorporated herein by reference.

Mannich bases suitable for use in the present invention are disclosed in U.S. Pat. Nos. 3,725,277; 3,751,365; 3,798,165; 4,116,644; 4,186,102; 4,334,085; 4,400,178; 4,663,063; 4,787,996; and 5,030,249, the relevant portions of which are incorporated herein by reference.

Polyalkylsuccinic amides, amines, imides, and imines suitable for use in the present invention are disclosed in U.S. Pat. Nos. 3,219,666; 3,268,587; 4,049,564; 4,089,794; 4,098,585; 4,240,803; 4,234,435; 4,357,250; 4,497,456; 4,647,390; 4,648,886; and 4,652,387, the relevant portions of which are incorporated herein by reference.

The relative proportions of the i) detergent component and ii) carrier components of the additive of the present invention are in an amount of 10 to 80 wt. %, preferably 15 to 35 wt %, of i) and 10 to 80 wt. %, preferably 25 to 50 wt %, of ii), based on the total weight of the additive, with ii) having a boiling point above 300° F., preferably above 650° F.

Optional Components

The carrier fluid can also contain an ester which is made by known techniques or is readily available from commercial sources. The amount of the ester can be from 1 to 80 wt. % based on the entire weight of the additive, more specifically, 2 to 60 wt. % or, even more specifically, 5 to 20 wt. %.

The ester is based on an ester of aliphatic or aromatic carboxylic acids, i.e., a mono-, di-, tri- or tetra-carboxylic acid. The aromatic ester can contain over 22 carbon atoms and can have a molecular weight ranging from 300 to 1,500, specifically, 400 to 1,200. To make the aromatic or aliphatic ester, a carboxylic acid substituted benzene or aliphatic compound is reacted with a linear alcohol containing at least 4 to 8 to at most 16 to 20 carbon atoms or a branched Oxo-alcohol containing at least 6 to 8, at most 16 to 20 carbon atoms. Representative examples of the alcohols from which the ester is derived include monohydric alcohols such as n-butanol, i-butanol, t-butanol, isopentyl alcohol and Oxo alcohols, which are prepared by the Oxo process. The Oxo process involves reacting olefins with carbon monoxide and hydrogen at temperatures of about 150° to 200° C. and pressures of about 30 to 400 atmospheres in the presence of a suitable catalyst. Examples of Oxo alcohols are those alcohols having 6 to 20 carbon atoms such as 2-methyl pentanol, 2-ethylhexanol, isodecanol, dodecanol and tridecanol. The foregoing alcohols are also readily available from commercial sources.

There are other ways to make the ester which are known in the art. These methods are best described in Kirk-Othmer "Encyclopedia of Chemical Technology," Vol 9, pages 291–309, John Wiley and Sons, New York, 1980. Such as, direct synthesis by reacting an organic alcohol and the carboxylic acid substituted benzene with elimination of water (see Kirk-Othmer "Encyclopedia of Chemical Technology" Volume 9, pages 306–307, John Wiley & Sons, New York, 1980). Additionally, a method for making the esters is described in U.S. Pat. No. 4,032, 550 and in U.S. Pat. No. 4,032,304 which are both incorporated by reference in their entirety.

The carrier fluid can optionally contain at least 1 to 10% or 5 to 30%, at most 50 to 80% of a mineral oil or synthetic oil which is used in addition to the other carrier fluid components. Representative of a suitable mineral oil is a solvent refined, naphthenic mineral oil or a hydrotreated naphthenic mineral oil or a paraffinic mineral oil of at least 100 SUS at 100° C., more specifically at least 300 to 500 SUS to at most 900 to 1200 SUS at 100° C. Representative of synthetic oils are polyolefins such as those derived from ethylene, propylene, 1-butene, hexene, octene, decene and dodecene and the like and copolymers of the foregoing.

The additive is blended in a concentration of from at least 10 to 100 to at most 200 to 500 pounds of additive per 1000 barrels (lb/MB) of fuel. The liquid fuel can be a liquid hydrocarbon fuel or an oxygenated fuel or mixtures thereof. Other fuels are contemplated as well, such as diesel oils and aviation fuels.

Specifically, however, the fuel compositions contemplated include gasoline base stocks such as a mixture of hydrocarbons boiling in the gasoline boiling range which is from about 90° F. to about 450° F. This base fuel may consist of straight chain or branched chain hydrocarbons, paraffins, cycloparaffins, olefins, aromatic hydrocarbons, or mixtures thereof. The base fuel can be derived from among others, straight run naphtha, polymer gasoline, natural gasoline or from catalytically cracked or thermally cracked hydrocarbons, alkylate and catalytically cracked reformed stock. The composition and octane level of the base fuel are not critical, and any conventional motor fuel base can be employed in the practice of this invention. However, the invention is best employed in premium unleaded and regular unleaded gasolines, although it is also effective in leaded gasolines. The fuels may be gasoline containing up to 50% alcohol or ethers. Further, the fuel may be an alcohol-type fuel containing over 50% to little or no hydrocarbon. Typical of such fuels are methanol, ethanol and mixtures of methanol and ethanol. Further examples of alcohol fuels are propanols, butanols, pentanols, and higher alcohols. The ether fuels can be methyl tert butyl ether, ethyl tert butyl ether, di-isobutyl ether, tert amyl methyl ether and the like. The fuels which may be treated with the additive included gasohols which may be formed by mixing 90 to 95 volumes of gasoline with 5–10 volumes of ethanol or methanol. A typical gasohol may contain 90 volumes of gasoline and 10 volumes of absolute ethanol.

The fuel compositions of the instant invention may additionally comprise any of the additives generally employed in fuel compositions. Thus, the compositions of the instant invention may contain solvents, co-detergents, anti-knock compounds such as tetraethyl lead, anti-icing additives, upper cylinder and fuel pump lubricity additives, antistatic agents, corrosion inhibitors, antioxidants, water scavengers, lead scavengers, dyes, lead octane appreciators, anti-smoke additives and the like.

The following examples will serve to illustrate the present invention without limiting the same.

EXAMPLE 1

A mixture of diamondoid compounds recovered from a diamondoid-containing natural gas well was fractionated to remove materials boiling below about 215° C., at atmospheric pressure in order to remove non-diamondoid light ends. The stripped product had the following properties as determined from gas chromatography:

| | | |
|---|---|---|
| Composition: | Bridgehead methyl adamantanes | 15.9 wt % |
| | Other adamantanes | 34.3 |
| | Diamantanes | 41.3 |
| | Triamantanes | 7.6 |
| | Tetramantanes | 0.3 |
| Viscosity: | 2.35 Cs at 100° C. and 8.19 cS at 40° C. | |
| VI: | 101 | |
| Pour Point | −94° C. | |

EXAMPLE 2

The diamondoid fluid recovered from a diamondoid-containing natural gas well described in Example 1 was distilled at 186° C./1.9 mm Hg pot temperature and 131° C./1.9 mm Hg overhead temperature to remove light ends which boiled below about 650° F. The residual diamondoid fluid with boiling points above about 650° F. had the following properties:

| | | |
|---|---|---|
| Composition: | Diamantanes | 22.9 wt % |
| | Triamantanes | 73.4 |
| | Tetramantanes | 3.7 |
| Viscosity: | 7.4 Cs at 100° C. and 48.3 Cs at 40° C. | |
| VI: | 115 | |
| Pour Point | <−43.4° C. | |

EXAMPLE 3

A standard gasoline additive A was formulated by blending 30 wt % of a 900–1000 MW polyisobutenyl bis succinimide, 28 wt % of alkylated phenol, 28% of tridecylphthalate ester and 14 wt % of 500" naphthenic oil.

Gasoline additives B and C were formulated by blending 30 wt % of the 900–1000 MW polyisobutenyl succinimide, 20 wt % of the alkylated phenol, 16 wt % of the tridecylphthalate ester, 14 wt % of 500" naphthenic oil and 20 wt % of the diamondoid fluid of Examples 1 and 2, respectively. The additives were added to gasoline in a treat rate of 560 ppm and the resulting gasoline was evaluated in a lawn mower deposit rate test and BMW Keep-Clean (KC) and Clean-Up test. The results are summarized below.

| | Lawn Mower deposit rate | BMW KC mg | BMW Clean-Up % |
|---|---|---|---|
| Additive A | −6.3 | −6.6 | 64 |

-continued

| | Lawn Mower deposit rate | BMW KC mg | BMW Clean-Up % |
|---|---|---|---|
| (control sample) | | | |
| Additive B | 1.1 | — | — |
| Additive C | 0.86 | 0.6 (5K mi) | — |
| | | −1.0 (10K mi) | 60 |

DESCRIPTION OF TEST METHODS

Lawn Mower Deposit Rate Test

This is an intake valve deposit screening test. In this test a lawn mower equipped with a 3.5 hp engine was used. The blade of the lawn mower was replaced with a 3.5 lb fly wheel. The intake valve and other engine parts were inspected after running for 35 hours. The intake valve deposit rate was measured as milligrams per hour×100.

BMW Keep-Clean Test

This test is performed in a BMW 318i 1.8 liter 4-cylinder engine and is further described in SAE Paper No. 892117. Starting with a clean, rebuilt engine, the test is run with fuel that has been treated with additive. The valves are removed and inspected at 5000 and 10000 miles. The driving cycle used consists of 10% city (varied speeds with stop and go and idling), 20% secondary (moderate speeds with infrequent stops) and 70% high (maximum sustained speed of 55 mph. The maximum deposit weight for BMW lifetime certification is 100 mg at 10000 miles.

BMW Clean-Up Test

This test is a modified version of the keep-clean test and is further described in SAE Paper No. 872117. In the clean up test the first 5000 miles are run using fuel treated with a $C_{18-24}$ alkyl bis succinimide additive designed to generated deposits on intake valves. Deposit weights are recorded at 5000 miles and the engine is reassembled. The second 5000 miles are run using fuel treated with the additive being tested. At 10000 miles the deposit weights are determined and the percentage of the deposits removed is calculated using the following formula.

$$\frac{(\text{Post dirty-up milligrams} - \text{Post clean-up milligrams})}{(\text{Post dirty-up milligrams})} \times 100$$

The results of the tests show that additives B and C which contain diamondoid fractions gave a very low deposit rate by the lawn mower test (0.86 to 1.1). Also, in actual BMW engine tests, the fuels containing diamondoids gave very low deposits. The diamondoid modified additive C had 60% clean up function which is comparable to that of additive A.

It is claimed:

1. An additive having detergency properties for normally liquid fuels comprising a combination of
   i) a detergent component and
   ii) a carrier fluid component comprising at least one compound selected from the group consisting of adamantane, diamantane, triamantane, tetramantane, and the alkyl-substituted derivatives thereof.

2. The additive of claim 1 in which i) is selected from the group consisting of polyamines, polyether amines, polyalkenyl succinimides, polyalkenyl succinic esters, Mannich bases, polyalkylsuccinic amides, polyalkylsuccinic amines, polyalkylsuccinic imides, and polyalkylsuccinic imines.

3. The additive of claim 1 wherein the relative proportions of the components are in an amount of 10 to 80 wt % of i) and 10 to 80 wt % of ii), based on the total weight of the additive, with ii) having a boiling point above 300° F.

4. The additive of claim 1 wherein i) comprises a polyalkenyl succinimide having a molecular weight of 600 to 3,000.

5. The additive of claim 4 in which the alkylene group of the polyalkenyl succinimide is a polyolefin made from 1-olefins which are ethylene, propylene, 1-butylene, 1-isobutylene, 1-pentene, 1-hexene, 1-octene, 1-decene or higher 1-olefins or copolymers thereof.

6. The additive of claim 1 in which the additive further comprises a mineral oil or synthetic oil.

7. The additive of claim 1 in which said component of ii) comprises at least two compounds selected from the group consisting of adamantane, diamantane, triamantane, tetramantane, and the alkyl-substituted derivatives thereof.

8. The additive of claim 1 in which the component of ii) comprises at least three compounds selected from the group consisting of adamantane, diamantane, triamantane, tetramantane, and the alkyl-substituted derivatives thereof.

9. The additive of claim 1 in which the component of ii) comprises at least three compounds selected from the group consisting of diamantane, triamantane, tetramantane, and the alkyl-substituted derivatives thereof.

10. The additive of claim 1 in which the component of ii) has a viscosity ranging from 1.5 to 40 cS at 100° C., a viscosity index (VI) ranging from 60 to 150, and a pour point less than −20° C.

11. The additive of claim 1 in which the component of ii) comprises up to 90 wt % adamantanes, up to 90 wt % diamantanes, up to 60 wt % triamantanes, and up to 25 wt % tetramantanes.

12. The additive of claim 1 in which the component of ii) comprises 10 to 60 wt % adamantanes, 20 to 80 wt % diamantanes, up to 50 wt % triamantanes, and up to 15 wt % tetramantanes.

13. A liquid fuel composition comprising a major amount of a liquid fuel and an additive having detergency, the additive comprising a combination of
   i) a detergent component; and
   ii) a carrier fluid comprising at least one component selected from the group consisting of adamantane, diamantane, triamantane, tetramantane, and the alkyl-substituted derivatives thereof.

14. The composition of claim 13 in which said fuel composition comprises gasoline and i) is selected from the group consisting of polyamines, polyether amines, polyalkenyl succinimides, polyalkenyl succinic esters, Mannich bases, polyalkylsuccinic amides, polyalkylsuccinic amines, polyalkylsuccinic imides, and polyalkylsuccinic imines.

15. The composition of claim 14 in which the polyalkenyl succinimide has a molecular weight of 600 to 3,000.

16. The composition of claim 13 in which the additive further comprises a mineral oil or synthetic oil.

17. The composition of claim 13 in which ii) comprises at least two compounds selected from the group consisting of adamantane, diamantane, triamantane, tetramantane, and the alkyl-substituted derivatives thereof.

18. The composition of claim 13 in which ii) comprises at least three compounds selected from the group consisting of adamantane, diamantane, triamantane, tetramantane, and the alkyl-substituted derivatives thereof.

19. The composition of claim 13 in which ii) is obtained from a diamondoid fluid.

20. The composition of claim 13 in which ii) has a viscosity ranging from 1.5 to 40 cS at 100° C., a viscosity index (VI) ranging from 60 to 150, and a pour point less than −20° C.

* * * * *